US012716222B2

(12) United States Patent
He et al.

(10) Patent No.: US 12,716,222 B2
(45) Date of Patent: Aug. 25, 2026

(54) SELF-OVERFLOW DRAINAGE JOINT

(71) Applicant: Taizhou Luqiao JOYHOO Sanitary Ware Factory, Zhejiang (CN)

(72) Inventors: Shumin He, Zhejiang (CN); Chao Xiao, Zhejiang (CN)

( * ) Notice: Subject to any disclaimer, the term of this patent is extended or adjusted under 35 U.S.C. 154(b) by 71 days.

(21) Appl. No.: 18/762,581

(22) Filed: Jul. 2, 2024

(65) Prior Publication Data

US 2024/0352718 A1 Oct. 24, 2024

(30) Foreign Application Priority Data

Jul. 4, 2023 (CN) ..... 202321748651.X

(51) Int. Cl.
*E03C 1/182* (2006.01)

(52) U.S. Cl.
CPC ..... *E03C 1/182* (2013.01)

(58) Field of Classification Search
CPC ..... E03C 1/182; E03C 1/24; E03C 1/232
USPC ..... 4/679–683, 694, 688, 286–295
See application file for complete search history.

(56) References Cited

U.S. PATENT DOCUMENTS 5,179,740 A * 1/1993 Marsilio ..... E03C 1/24 4/651
2002/0112285 A1* 8/2002 Minnick ..... E03C 1/24 4/694

FOREIGN PATENT DOCUMENTS

EP 1967665 A2 * 9/2008 ..... E03C 1/24
ES 2329786 T3 * 12/2009 ..... E03C 1/232

* cited by examiner

*Primary Examiner* — Tuan N Nguyen
(74) *Attorney, Agent, or Firm* — Hawaii Patent Services; Nathaniel K. Fedde; Kenton N. Fedde

(57) ABSTRACT

A self-overflow drainage joint comprises a joint body, wherein the joint body comprises a flow channel, a water inlet and a water outlet; an end of the joint body at the water inlet is matched with a drainer to be fixed to form a combined state that the drainer is communicated with the joint body; and the self-overflow drainage joint is wherein the end of the joint body at the water inlet is provided with an overflow area, and at least one overflow hole communicated with the flow channel is formed in the overflow area.

12 Claims, 4 Drawing Sheets

SELF-OVERFLOW DRAINAGE JOINT

CROSS-REFERENCE TO RELATED APPLICATIONS

This application claims the priority of China patent application No. 202321748651.X filed on Jul. 4, 2023, entitled "Self-overflow drainage joint", and the entire contents, including the amendments therein, of which are all incorporated herein by reference.

TECHNICAL FIELD

The present invention relates to the technical field of drainer, in particular to a self-overflow drainage joint.

BACKGROUND

A drainer refers to the drainage device placed in the drainer of bathtub and basin, which is used to drain the water in the bathtub and basin into the drainer. It has the functions of draining and storing water. The existing drainers can be divided into bouncing-type drainers, flip-type drainers and lifting-type drainers according to types. According to the material, drainers can be divided into copper drainers, stainless steel drainers, plastic drainers, etc. According to the use, drainers can be divided into bathtub drainers, basin drainers and so on.

The sink drainer is something we use every day, which is widely used in every household. According to the shape and structure of the drainer, it can be divided into drainer part and overflow pipe part. In the prior art, for example "Waste water outlet unit" disclosed in U.S. Pat. No. 8,813,273, and "SEWEROVERFLOWRELIEFDEVICE" disclosed in U.S. Patent. No. 20100108159A1, the drainage function is assisted by arranging a drainage connector on the drainer, but it does not have the structure of being connected to an overflow pipe.

In the prior art, such as "press-type overflow drainage device for water container" disclosed in U.S. Pat. No. 11,441,301, it provides a pressure overflow drainage device for a water container with a water outlet and an overflow port, but the existing drainer connectors are usually without overflow holes. Therefore, it is necessary to choose a drainer with or without overflow holes. The choice of a drainer depends on whether the basin has overflow holes. The drainer with overflow holes can be used in the basin without overflow holes, and the drainer without overflow holes can also be used in the basin with overflow holes. In different use environments, it is necessary to use the drainer with overflow holes or the drainer without overflow holes, which is limited in use and not universal enough.

Considering the high cost of directly replacing the drainer, it is necessary to provide a self-overflow drainage joint, which can be suitable for different drainers with or without overflow holes. When the joint body is connected with the drainer with overflow holes, the water overflowed by the overflow holes can overflow; when the joint body is connected with a drainer without an overflow port, the joint body drains water normally, and the manufacturing cost is low and the universality is high.

SUMMARY

The present invention provides a self-overflow drainage joint, which includes a joint body, wherein the joint body comprises a flow channel, a water inlet and a water outlet; an end of the joint body at the water inlet is matched and fixed with a drainer to form a combined state in which the drainer is communicated with the joint body; wherein, the end of the joint body at the water inlet is provided with an overflow area, and at least one overflow hole communicated with the flow channel is formed in the overflow area.

The present invention further provides a self-overflow drainage joint, which includes a joint body, wherein the joint body comprises a flow channel, a water inlet and a water outlet, wherein an end of the joint body at the water inlet is matched and fixed with a drainer to form a combined state in which the drainer is communicated with the joint body, wherein the end of the joint body at the water inlet is provided with an overflow area, and at least one overflow hole communicated with the flow channel is formed in the overflow area; the joint body is provided with a mounting part which is matched and fixed with the drainer and a peripheral part located at a periphery of the mounting part, and the overflow area is formed between the peripheral part and the mounting part.

The present invention further provides a self-overflow drainage joint, which includes a joint body mounted to a drainer, the joint body comprising a flow channel communicated with a water inlet and a water outlet, wherein the joint body further comprises an overflow area formed on an outer wall of the joint body and an overflow hole communicated with the overflow area and the flow channel, and the overflow hole is opened in a shade area of the overflow area on the outer wall of the joint body.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
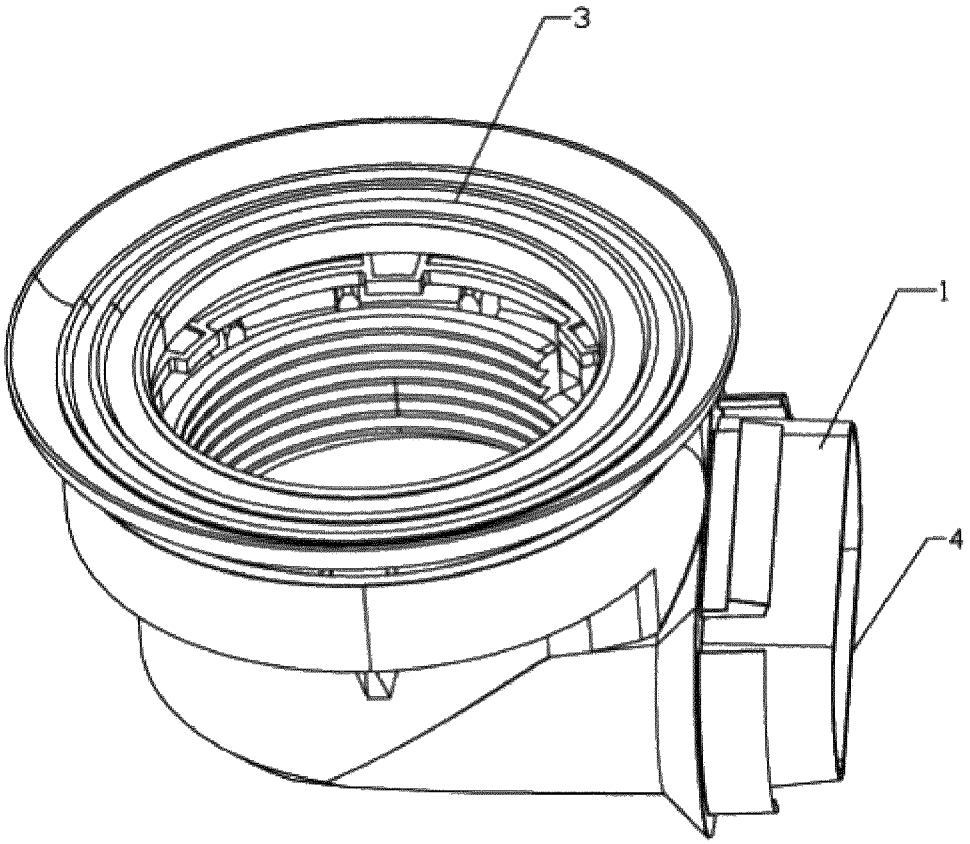
FIG. 1 is a structural schematic diagram of the present invention.

Joint body (1); Flow channel (2); Water inlet (3); Water outlet (4); Overflow area (5); Overflow hole (6); Mounting part (7); Peripheral part (8); linking part (9); Conical bottom wall (10); Planar bottom wall (11); Threaded mounting hole (12); Support plate (13); First gasket (14); Side opening (15); Second gasket (16); Water outlet pipe (17); Vertical channel (18); Horizontal channel (19).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Figure 2:
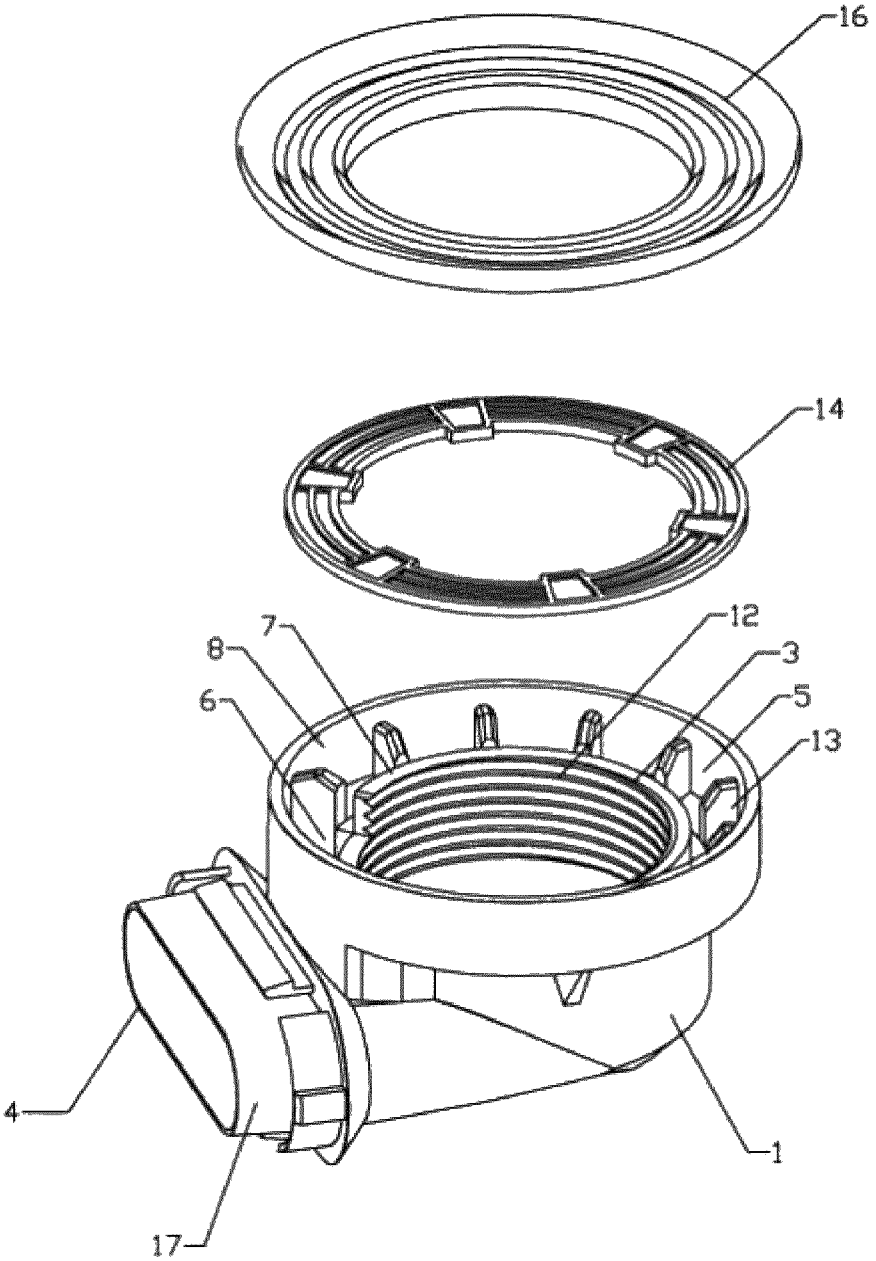
FIG. 2 is an exploded view of the present invention.
Figure 3:
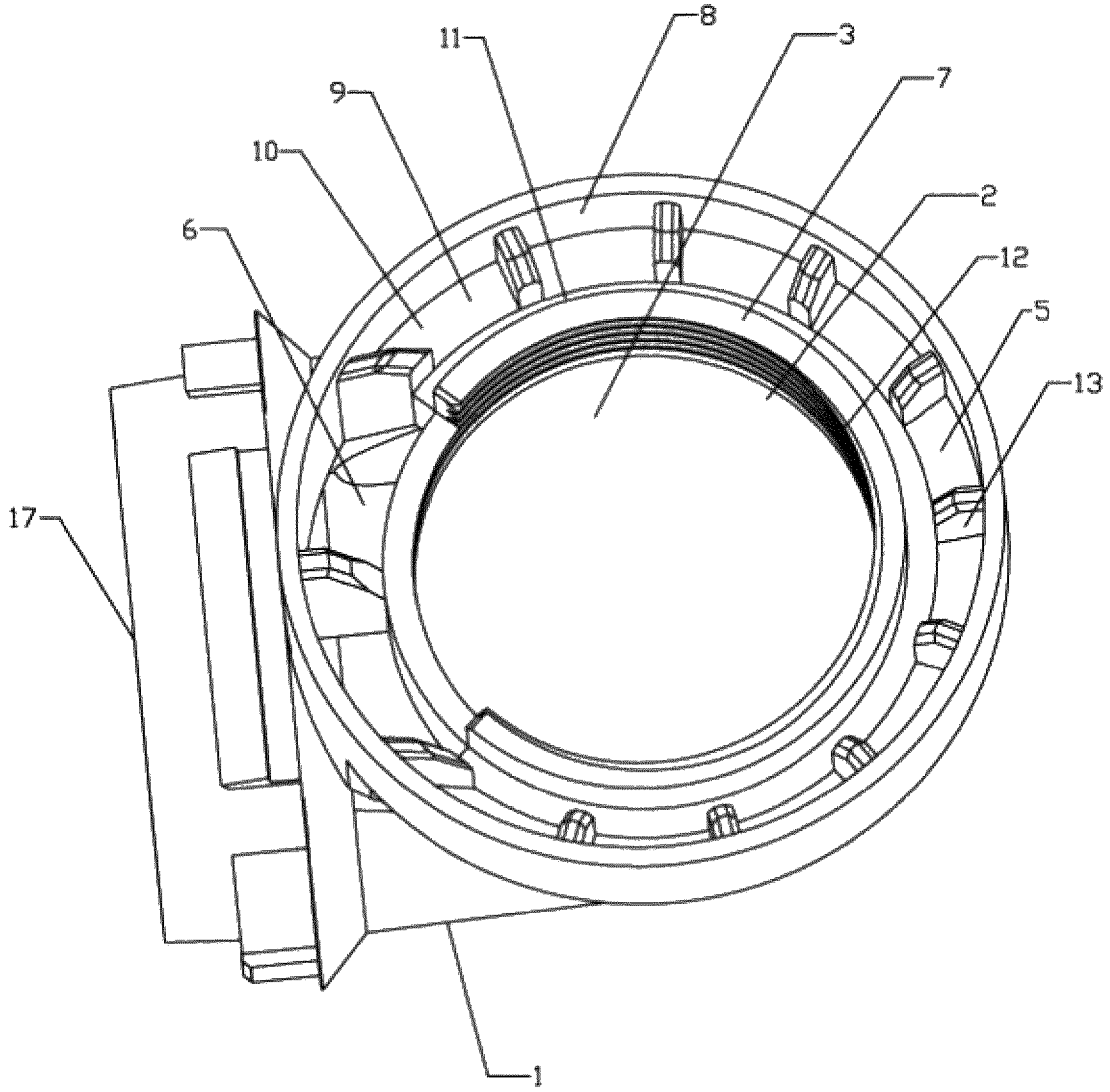
FIG. 3 is a schematic structural view of the joint body in the present invention.
Figure 4:
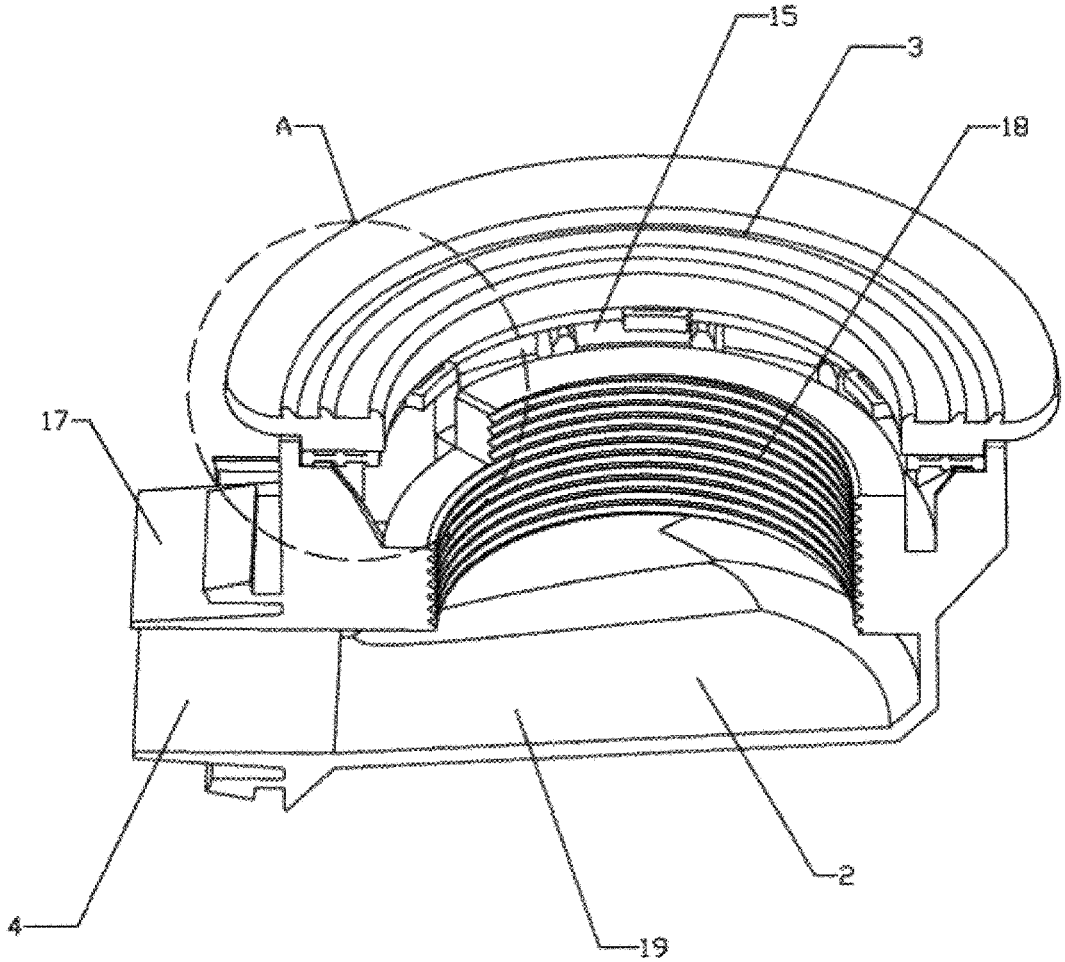
FIG. 4 is a structural schematic diagram of the present invention.
Figure 5:
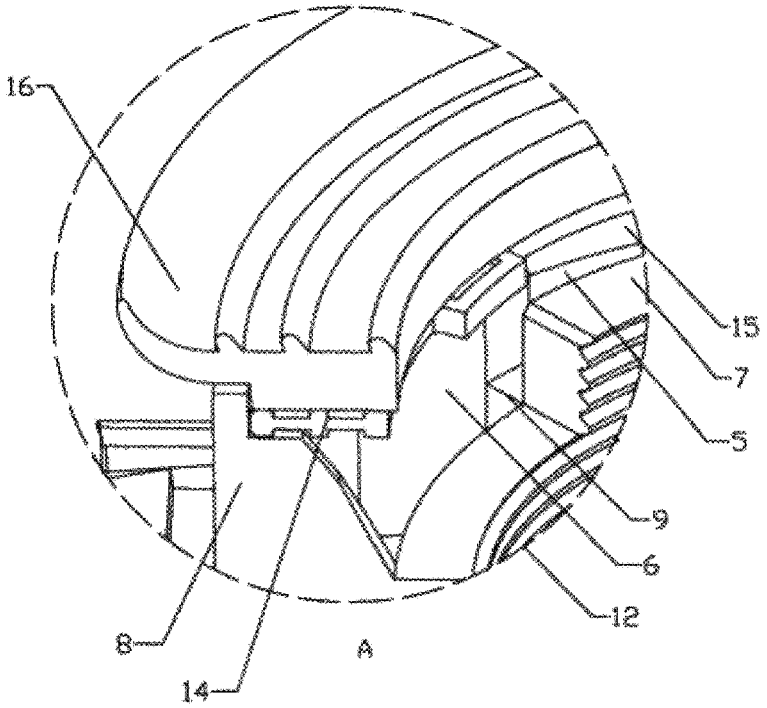
FIG. 5 is an enlarged view of part A of FIG. 4.

As shown in FIGS. 1 to 5, a self-overflow drainage joint includes a joint body 1, which includes a flow channel 2, a water inlet 3 and a water outlet 4. An end of the joint body 1 at the water inlet 3 is fixed with a drainer to form a combined state in which the drainer communicates with the joint body 1. The end of the joint body 1 at the water inlet 3 is provided with an overflow area 5, and at least one overflow hole 6 communicated with the flow channel 2 is opened in the overflow area 5. The overflow hole 6 is arranged on the joint body 1, which can be suitable for different use environments, and only different joints need to be replaced in the later stage, so that the manufacturing cost is low and the versatility is high.

In some embodiments, a self-overflow drainage joint provided by the present invention comprises a joint body 1 mounted to a drainer, the joint body 1 comprises a flow channel 2 communicated with a water inlet 3 and a water outlet 4; the joint body 1 further comprises an overflow area 5 formed on the outer wall of the joint body 1 and an overflow hole 6 communicated with the overflow area 5 and the flow channel 2, and the overflow hole 6 is opened in the shade area of the overflow area 5 on the outer wall of the joint body 1. The inlet of the overflow area is provided with a sealing mechanism or universal/general-utility interface to adapt to different types of overflow pipes on the overflow outlet and to seal the overflow area when the overflow pipe is not connected.

The joint body 1 is provided with a mounting part 7 which is fixed with the drainer and a peripheral part 8 which is located at the periphery of the mounting part 7, and the overflow area 5 is formed between the peripheral part 8 and the mounting part 7. Whether it is a washbasin with an overflow port or a washbasin without an overflow port, the drainage joint with an overflow hole 6 can be used. When in use, the threaded part of the drainer is screwed with the mounting part 7, and if the washbasin does not have an overflow port, the fluid normally passes through the drainage joint, and the fluid is less likely to leak from the overflow hole 6 of the drainage joint. If the basin has an overflow port, part of the fluid higher than the water level line of the basin will enter the overflow area 5 and be discharged into the flow channel 2 through the overflow hole 6. In some embodiments (not shown in the figure), an opening and closing mechanism or a one-way valve is arranged on the overflow hole 6 to improve the influence of preventing overflow from flowing back, and the overflow hole 6 can be designed to be arranged in a plurality of different positions or with different apertures to control the amount of overflow water.

In some embodiments (not shown in the figure), the peripheral part 8 is provided with an interface which can be connected with a water pipe, and the interface is communicated with the overflow area 5, and is connected with the overflow drainage joint installed on the side wall of the sink through the overflow pipe. When the water is accumulated to a certain height to the overflow drain joint, it can flow from the through hole of the overflow head to the overflow area 5 along a connecting pipe assembly and finally be discharged through the flow passage 2. The flow rate of the overflow head of the present invention can be higher than the running water speed of the faucet; the connecting pipe assembly is divided into multiple sections, which can be easily disassembled and replaced. Compared with the design of connecting the filter drainage joint and overflow drainage joint with a whole hose, it is not necessary to replace the whole part, which is simple to install and disassemble, lower in cost and saves resources.

The mounting part 7 and the peripheral part 8 are integrally formed on the joint body 1, and the overflow hole 6 is opened at the bottom of the overflow area 5. In this embodiment, the drainage joint is integrally injection molded, which is convenient to manufacture and low in cost.

The bottoms of the mounting part 7 and the peripheral part 8 are connected into a whole through the linking part 9, which comprises a conical bottom wall 10 and a planar bottom wall 11 located in the overflow area 5. The ends of the conical bottom wall 10 and the planar bottom wall 11, which are far away from each other, re connected with the peripheral part 8 and the mounting part 7 respectively. The height of the end of the conical bottom wall 10 connected with the planar bottom wall 11 is lower than that of the end of the conical bottom wall 10 connected with the peripheral part 8, and the fluid can flow to the overflow hole 6 under the action of the conical bottom wall 10 after entering the overflow area 5.

The mounting part 7 is internally provided with a threaded mounting hole 12 which is threadedly matched with the drainer, so that the drainer and the drainage joint can be assembled more conveniently. In some embodiments (not shown in the figure), the drainer and the drainage joint can also be assembled in the form of clamping and plugging, and the threaded connection mode in the application is preferred.

A plurality of support plates 13 are arranged in the overflow area 5 at intervals along the circumferential direction, and the height of the support plates 13 is lower than that of the peripheral part 8 and a first gasket is placed on the support plate 13. In this embodiment, a height difference is formed between the support plate 13 and the peripheral part 8, and a space for placing the first gasket 14 can be formed. The first gasket 14 can be a plastic first gasket 14, a rubber first gasket 14, etc.; and a bowl-shaped second gasket 16 is also arranged on the first gaskets 14, and the second gasket 16 is commercially available.

A height difference is formed between the mounting part 7 and the support plate 13, and the height of the mounting part is lower than that of the support plate 13. A side opening 15 is formed between the inside of the first gasket 14 and the mounting part 7. After the drainage joint and the drainer are assembled, when a basin with an overflow outlet is used, part of the fluid that crosses the water level line can enter the overflow area 5 through the side opening 15 and be discharged into the flow channel 2 of the joint body 1 from the overflow hole 6.

The side wall of the joint body 1 extends to form a water outlet pipe 17 with a flat mouth structure, and the water outlet 4 is arranged at the outer end of the water outlet pipe 17, and the water outlet 4 is runway-shaped. By designing the flat mouth structure, the height of the joint can be reduced and the joint can be miniaturized and thinner.

The flow channel 2 includes a vertical channel 18 and a horizontal channel 19, the inner bottom wall of the horizontal flow channel 2 gradually inclines downward from the inside to the outside, and the inclined inner bottom wall can make the fluid flow out better. In this embodiment, the overflow hole 6 is arranged to communicate with the horizontal channel 19, and the fluid in the overflow area 5 is guided to be discharged into the horizontal channel 19 of the joint body 1 through the surface of the overflow area 5. In some embodiments (not shown in the figure), the overflow hole 6 is designed to be communicated with the vertical channel 18, and the overflow hole 6 can be provided with a certain inclination angle to guide the fluid in the overflow area 5 into the vertical channel 18.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A self-overflow drainage joint, comprising a joint body, wherein the joint body comprises a flow channel, a water inlet and a water outlet; an end of the joint body at the water inlet is matched and fixed with a drainer to form a combined state in which the drainer is communicated with the joint body; wherein, the end of the joint body at the water inlet is provided with an overflow area, and at least one overflow hole communicated with the flow channel is formed in the overflow area, wherein the joint body is provided with a mounting part which is matched and fixed with the drainer and a peripheral part located at a periphery of the mounting part, and the overflow area is formed between the peripheral part and the mounting part, wherein the mounting part and the peripheral part are integrally formed on the joint body, and the at least one overflow hole is opened at a bottom of the overflow area, wherein bottoms of the mounting part and the peripheral part are connected into a whole through a linking part, and the linking part comprises a conical bottom wall and a planar bottom wall located in the overflow area; ends of the conical bottom wall and the planar bottom wall which are far away from each other are connected with the peripheral part and the mounting part respectively, and a height of an end of the conical bottom wall connected with the planar bottom wall is lower than that of the conical bottom wall connected with the peripheral part.

2. The self-overflow drainage joint according to claim 1, wherein the mounting part is internally provided with a threaded mounting hole which is threadedly matched with the drainer.

3. The self-overflow drainage joint according to claim 1, wherein a plurality of support plates are arranged in the overflow area at intervals along a circumferential direction, a height of each of the plurality of support plates is lower than that of the peripheral part, and a first gasket is placed on each of the plurality of support plates.

4. The self-overflow drainage joint according to claim 3, wherein the mounting part and the plurality of support plates form a height difference and a height of the mounting part is lower than that of the plurality of support plates, and a side opening is formed between an inner side of the first gasket and the mounting part.

5. The self-overflow drainage joint according to claim 3, wherein the first gasket is further provided with a bowl-shaped second gasket.

6. The self-overflow drainage joint according to claim 1, wherein a side wall of the joint body extends to form a water outlet pipe with a flat mouth structure, the water outlet is arranged at an outer end of the water outlet pipe, and the water outlet is runway-shaped.

7. The self-overflow drainage joint according to claim 6, wherein the flow channel comprises a vertical channel and a horizontal channel, and an inner bottom wall of the horizontal channel gradually inclines downwards from inside to outside.

8. The self-overflow drainage joint according to claim 1, wherein support plates are disposed on the conical bottom wall at intervals along a circumferential direction, and a first gasket is placed on the support plates.

9. The self-overflow drainage joint according to claim 1, wherein the overflow area is delimited by the conical bottom wall and the peripheral part.

10. A self-overflow drainage joint, comprising a joint body mounted to a drainer, the joint body comprising a flow channel communicated with a water inlet and a water outlet, wherein the joint body further comprises an overflow area formed on an outer wall of the joint body and an overflow hole communicated with the overflow area and the flow channel, and the overflow hole is opened in a shade area of the overflow area on the outer wall of the joint body, wherein the joint body is provided with a mounting part which is matched and fixed with the drainer and a peripheral part located at a periphery of the mounting part, and the overflow area is formed between the peripheral part and the mounting part, wherein the mounting part and the peripheral part are integrally formed on the joint body, and the overflow hole is opened at a bottom of the overflow area, wherein bottoms of the mounting part and the peripheral part are connected into a whole through a linking part, and the linking part comprises a conical bottom wall and a planar bottom wall located in the overflow area, ends of the conical bottom wall and the planar bottom wall which are far away from each other are connected with the peripheral part and the mounting part respectively, and a height of an end of the conical bottom wall connected with the planar bottom wall is lower than that of the conical bottom wall connected with the peripheral part.

11. The self-overflow drainage joint according to claim 10, wherein support plates are disposed on the conical bottom wall at intervals along a circumferential direction, and a first gasket is placed on the support plates.

12. The self-overflow drainage joint according to claim 10, wherein the overflow area is delimited by the conical bottom wall and the peripheral part.

* * * * *